US011805919B1

(12) United States Patent
Raiszadeh et al.

(10) Patent No.: US 11,805,919 B1
(45) Date of Patent: Nov. 7, 2023

(54) ADJUSTABLE PRONE BODY SUPPORT APPARATUS

(71) Applicant: Kamshad Raiszadeh MD, Rancho Santa Fe, CA (US)

(72) Inventors: Kamron Jaspar Raiszadeh, Rancho Santa Fe, CA (US); Kamshad Raiszadeh, Rancho Santa Fe, CA (US); John Souza, Monroe, NC (US); Kassi Rose, Charlotte, NC (US)

(73) Assignee: Kamshad Raiszadeh MD, Rancho Santa Fe, CA (US)

( * ) Notice: Subject to any disclaimer, the term of this patent is extended or adjusted under 35 U.S.C. 154(b) by 0 days.

(21) Appl. No.: 18/141,106

(22) Filed: Apr. 28, 2023

Related U.S. Application Data

(63) Continuation of application No. 17/726,471, filed on Apr. 21, 2022.

(51) Int. Cl.
*A47C 9/00* (2006.01)

(52) U.S. Cl.
CPC ..... *A47C 9/005* (2013.01)

(58) Field of Classification Search
CPC ..... A47C 9/005; A61G 2200/325
USPC ..... 297/900, 423.11
See application file for complete search history.

(56) References Cited

U.S. PATENT DOCUMENTS

| | | | | |
|---|---|---|---|---|
| 5,720,517 | A * | 2/1998 | Prothro, Sr. | A47C 9/002 297/451.3 |
| 9,498,398 | B1 * | 11/2016 | Ehrenleitner | A61G 15/02 |
| 2011/0012397 | A1 * | 1/2011 | Wallace | A47C 9/005 297/195.11 |
| 2013/0307298 | A1 * | 11/2013 | Meiki | A61G 5/10 297/68 |
| 2019/0125605 | A1 * | 5/2019 | Skursky | A61G 15/007 |
| 2020/0237474 | A1 * | 7/2020 | Muller | A61B 90/60 |

* cited by examiner

*Primary Examiner* — Sarah B McPartlin
(74) *Attorney, Agent, or Firm* — McNees Wallace & Nurick LLC

(57) ABSTRACT

In an exemplary embodiment, a prone body support apparatus for operating a work object is disclosed. The prone body support apparatus includes a base, and a secondary frame and a primary frame. The secondary frame includes a head support for supporting a headrest pad, a torso support and a hip support, the torso and hip supports may be moveable with respect to each other, and a posterior brace, all of which may include a pad. The primary frame includes a knee-adjacent thigh brace and a media emplacement for supporting a work object.

15 Claims, 11 Drawing Sheets

ADJUSTABLE PRONE BODY SUPPORT APPARATUS

RELATED APPLICATION

The present application is a continuation of and claims priority to U.S. application Ser. No. 17/726,471 entitled ADJUSTABLE PRONE BODY SUPPORT APPARATUS, which was filed on Apr. 21, 2022, the entirety of which is incorporated herein by reference.

TECHNICAL FIELD

The present disclosure relates to an adjustable a prone body support apparatus. More specifically, the present disclosure is directed to an adjustable prone body support apparatus for use with a work object, for example, a portable computing device.

BACKGROUND

People widely use portable electronic devices, such as laptops, tablets, smartphones, e-readers, handheld gaming device, etc. for a variety of purposes including entertainment and work. Typically, these users are seated when using these devices. For example while at home, school or in an office work environment, a user of electronic devices and broadly other work objects may use a chair, a desk, and a keyboard. Use of these devices in a sitting posture over extended periods of time has been shown to cause uncomfortable physiological symptoms and detrimental health effects. The physiological symptoms include fatigue, sleepiness, restlessness, muscle aches, back and neck pain, and in some cases depression. The health effects include muscle weakness, skeletal misalignment, muscle and joint tightness, disorders of the circulatory system commonly associated with inactivity, and other symptoms.

In order to improve the health and comfort of the user, one solution has been to use a non-seated solution. One approach is a computer platform stand, which is an apparatus configured to rest on a surface of the desk to elevate the viewing height of a display on the computer. In most situation, the user is standing next to the desk while the computer is at the elevated height. These solutions are portable though they require the presence of a table or other suitable surface to be useful. Another approach has been the use of an adjustable workstation desk, which typically includes an elevator system often in form of a manual mechanism (e.g., a crank) or an automatic mechanism (e.g., an electric motor) to change the height of the desk and are typically large and heavy and not easily portable. While standing desks may accomplish some relief from the less desirable aspects of sitting, height adjustable workstations. However, standing for a prolong periods of time exert forces on the body causing discomfort and injury (i.e., back, neck, and shoulder pain). Yet other solutions are known in the art, including kneeling chairs, and fully reclined table type supports with attached or attachable head supports. But kneeling chairs do not relieve the problems associated with inactivity and upright positioning and also can prove to be uncomfortable and potentially damaging to the user's knees and extremities. And fully prone positions are generally not feasible for most environments and can cause strain and injury to a user's back and neck.

In view of the problems associated with conventional desks, workstations, and various alternatives, there remains a need to provide a seating solution that avoids negative health effects that can be caused by standing, upright and kneeling positions, such as muscle weakness, skeletal misalignment, muscle and joint tightness, disorders of the circulatory system commonly associated with inactivity, and other symptoms.

According to the instant disclosure, the inventive prone body support apparatus establishes the user in an ergonomically favorable position that minimizes pressure on the wrists and the spine and in some embodiments includes three point stabilization which provides enhanced muscle contraction and activation in the buttocks and legs, lending to improved circulation among other benefits.

SUMMARY

In various embodiments, a prone body support apparatus for as an alternative to conventional seating and workstations is disclosed.

In a first embodiment, the prone body support apparatus provides upper body support and lower body three-point fixation to brace the knee-adjacent portions of the user's thighs, the posterior and one or more feet of the user to enable stable and physiologically activating engagement of the lower body musculature.

According to such embodiments, the prone body support apparatus includes a base, and primary and secondary frames supported by the base, the primary and secondary frames being configured to support a body. The secondary frame includes a head support, a torso support, a hip support, and a posterior brace. In some embodiments, one or more of the head, torso and hip supports and the posterior brace may include discrete pads for comfort. In some embodiments, the torso and hip supports are interconnected by an adjustable integrated upper body support that includes, in some embodiments, first and second upper body support frames that are movable to adjust each of the torso and hip supports towards and away from one another. In some embodiments the torso and hip supports are formed as an integrated upper body support that is not adjustable. The primary frame includes a knee-adjacent thigh brace and a media emplacement for support a work object, for example, a computing device. In some embodiments, one or both of the knee-adjacent thigh brace and the foot brace may include discrete pads for comfort. In some embodiments, the primary and secondary frames are adjustably connectable or connected to allow for disassembly, collapsing or folding, and conversion of the apparatus between a prone orientation and an upright orientation. In some embodiments, the primary frame is adjustably connectable or connected to the base.

In another embodiment of the prone body support apparatus, the apparatus includes a secondary frame and a primary frame attached to a base. The frames may be fixed and not adjustable. In some embodiments, the frames are adjustable.

In some embodiments, primary frame includes a head support that is adjustable with respect to the primary frame to allow for adjustment of a neck region of a user, a body support that is adjustable with respect to the primary frame to allow for adjustment of a chest region of the user, and a secondary frame that includes a hip support that may be fixed or adjustable with respect to the secondary frame to allow for adjustment of a hip region of the user. In some embodiments, the primary and secondary frame are movably adjustable relative to each other by motion of one or both frames along a long axis of the apparatus from the head toward the hip regions, and in some such embodiments, such adjustability is the means by which one or both of the torso and hips are adjusted. In some embodiments, the apparatus includes opposing arm supports that may be adjustable with respect to the primary or secondary frame to allow for adjustment to support the arms of the user, and a media emplacement that is adjustable with respect to the primary frame to allow for adjustment of a viewing distance of the user.

Other features and advantages of the present invention will be apparent from the following more detailed description of the preferred embodiment which illustrates, by way of example, the principles of the invention.

Figure 1:
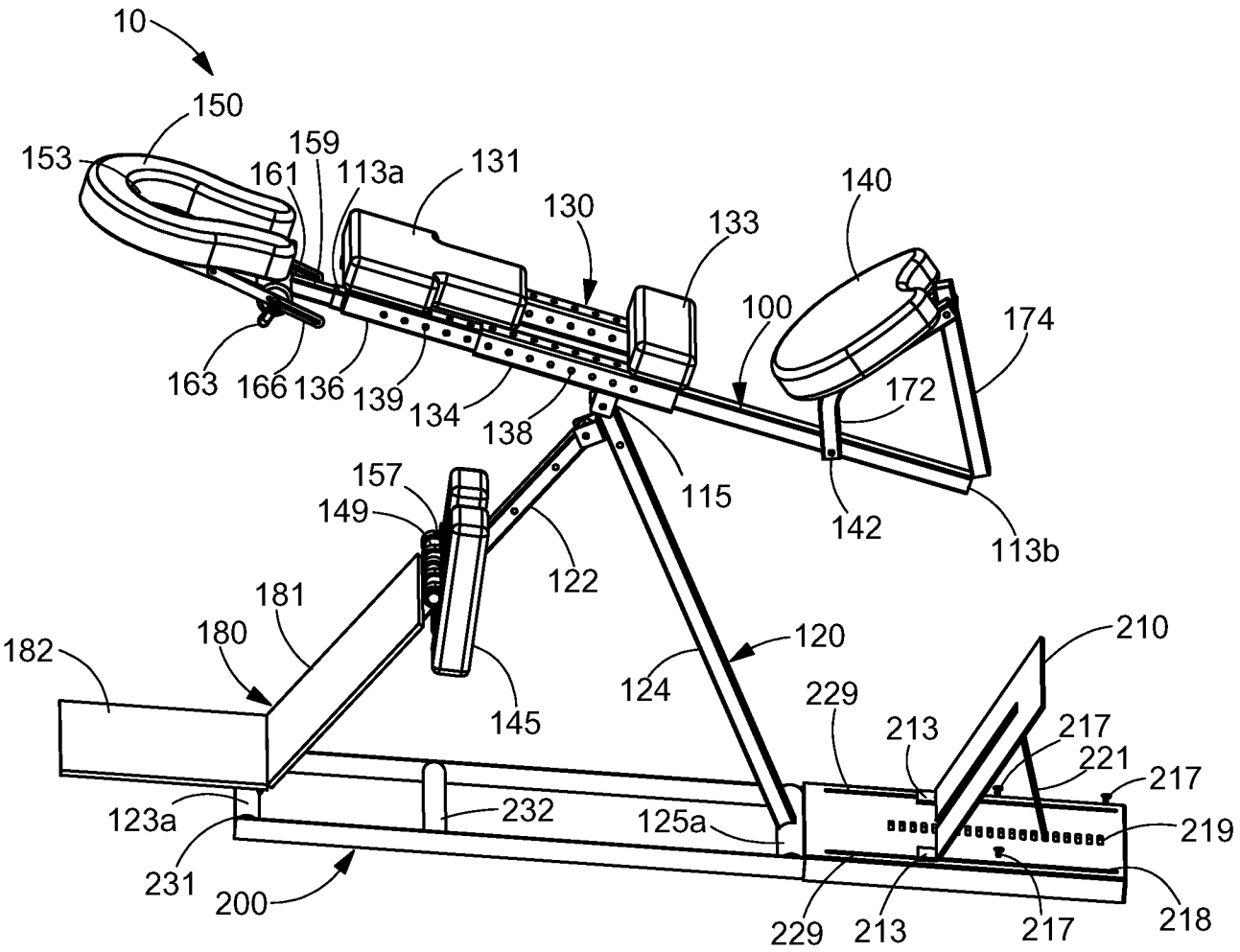
FIG. 1 is a perspective view of a prone body support apparatus, according to an example embodiment of the present disclosure.

It should be noted that the drawings are intended to illustrate the general characteristics of methods, structure and/or materials utilized in certain example embodiments and to supplement the written description provided below. These drawings are not, however, to scale and may not precisely reflect the precise structural or performance characteristics of any given embodiment and should not be interpreted as defining or limiting the range of values or properties encompassed by example embodiments. For example, the relative thicknesses and positioning of layers, regions and/or structural elements may be reduced or exaggerated for clarity. The use of similar or identical reference numbers in the various drawings is intended to indicate the presence of a similar or identical element or feature.

DETAILED DESCRIPTION

In various embodiments, the prone body support apparatus according to the present disclosure provides head, upper body and leg and pelvis support while a user is positioned on the prone body support apparatus in a prone position. The prone body support apparatus supports the pelvis, upper back, lower back, shoulders, neck, and forearms of the user while easily operating or manipulating a work object, such as, but not limited to, a portable computing device, such as, for example, a laptop, a tablet, a smartphone, an e-reader, a handheld gaming device, or a small television, or a book, notebook, or other work object.

In various embodiments, present prone body support apparatus is lightweight and portable and can be easily assembled and disassembled. In some embodiments, the prone body support apparatus has a compact design and can be folded for easy storage. The prone body support apparatus is ultra-simple to use and manufacture.

In various embodiments, the user's hands can be supported in a vertical configuration by resting on the media emplacement, thus taking pressure off of the wrists to optimize the avoidance of wrist discomfort and injuries, e.g., carpal tunnel syndrome.

In some embodiments, the prone body support apparatus is a whole-body stabilizer, which employs adjustability (i.e., moveability) and physical design features including a head support, a torso support, a hip support, a posterior support, a knee-adjacent thigh brace portion, and a foot brace, to assure support and comfort while seated on the prone body support apparatus and operating the work object. In some embodiments, the chest and pelvis of the user are supported by the torso support and the hip support, respectively, to distribute the user's weight and allow shifts (movement) to relieve pressure of the back and shoulders and for comfort. Further, in some embodiments that include the posterior support, knee-adjacent thigh brace portion, and foot brace three-point fixation, the user is provided stability and to positioning suitable to enable activation of the lower extremity muscles to support blood flow and fitness. According to such embodiments, the lower body from the waist down is braced by the three-part fixation in a manner that allows the user to independently move each of their legs while remaining supported, and in some embodiments, to optionally maintain contact of one or both feet with the foot brace while exercising by pressing the foot brace slidably or rotatably along a long axis of the apparatus. Thus, the apparatus supports performing exercises to contract the gluteal muscles and quadriceps. This optimizes opportunity for blood circulation to the lower extremities and/or prevent sedentary behaviors.

In a first embodiment, the prone body support apparatus provides upper body support and lower body three-point fixation to brace the knee-adjacent portions of the user's thighs, the posterior and one or more feet of the user to enable stable and physiologically activating engagement of the lower body musculature.

According to such embodiments, the prone body support apparatus includes a base, and primary and secondary frames supported by the base, the primary and secondary frames being configured to support a body. The secondary frame includes a head support, a torso support, a hip support, and a posterior brace. In some embodiments, one or more of the head, torso and hip supports and the posterior brace may include discrete pads for comfort. In some embodiments, the torso and hip supports are interconnected by an adjustable integrated upper body support that includes, in some embodiments, first and second upper body support frames that are movable to adjust each of the torso and hip supports towards and away from one another. In some embodiments the torso and hip supports are formed as an integrated upper body support that is not adjustable. The primary frame includes a knee-adjacent thigh brace and a media emplacement for support a work object, for example, a computing device. In some embodiments, one or both of the knee-adjacent thigh brace and the foot brace may include discrete pads for comfort. In some embodiments, the primary and secondary frames are adjustably connectable or connected to allow for disassembly, collapsing or folding, and conversion of the apparatus between a prone orientation and an upright orientation. In some embodiments, the primary frame is adjustably connectable or connected to the base.

Advantageously, the disclosed inventive prone body support apparatus, in various embodiments, provides mechanical and physiologic benefits that are not addressed by conventional support devices known in the art such as partially prone massage tables, kneeling chairs, and prone massage tables.

Lumbar disc studies starting in the early 1980s revealed a significant decrease in intradiscal pressure between lying down and sitting. Later research noted the lowest pressure, approximately 20% of standing pressure was found with patients in supine position with only slightly higher pressure of approximately 22% for lying in the prone position. In contrast, for sitting relaxed without a backrest, intradiscal pressure has been measured at 90% of the value for standing. These studies reveal that a prone position decreases pressure on cervical discs and soft tissues as compared with seated and standing positions. An aspect of the pressure experienced in the lumbar spine is contributed by the weight of the user's head. The head weighs approximately 12 lbs., and any flexion of the head (for example about (15 degrees) results insignificantly increased weight transmission (measured in some studies at about 27 lbs.). Resting the head on a surface, for example a horseshoe type headrest such as those found on massage tables, can theoretically significantly decreases the effective weight of the head.

It has further been demonstrated that as compared to the supine position where the wrists are in a horizontal position and need to resist gravity, the prone position allows the wrists and forearms to be in a more vertical position theoretically decreasing stress on the carpal tunnel and wrist tendons.

Regarding the buttocks and legs, prone positioning allows the user to engage the glutes, thigh and calf muscles and stretch the calves, though in a fully prone position the user cannot comfortably engage the buttocks and legs without causing discomfort in the lower back. In contrast to a prone position, upright sitting results in the lower extremities being passive and inactive.

Figure 9:
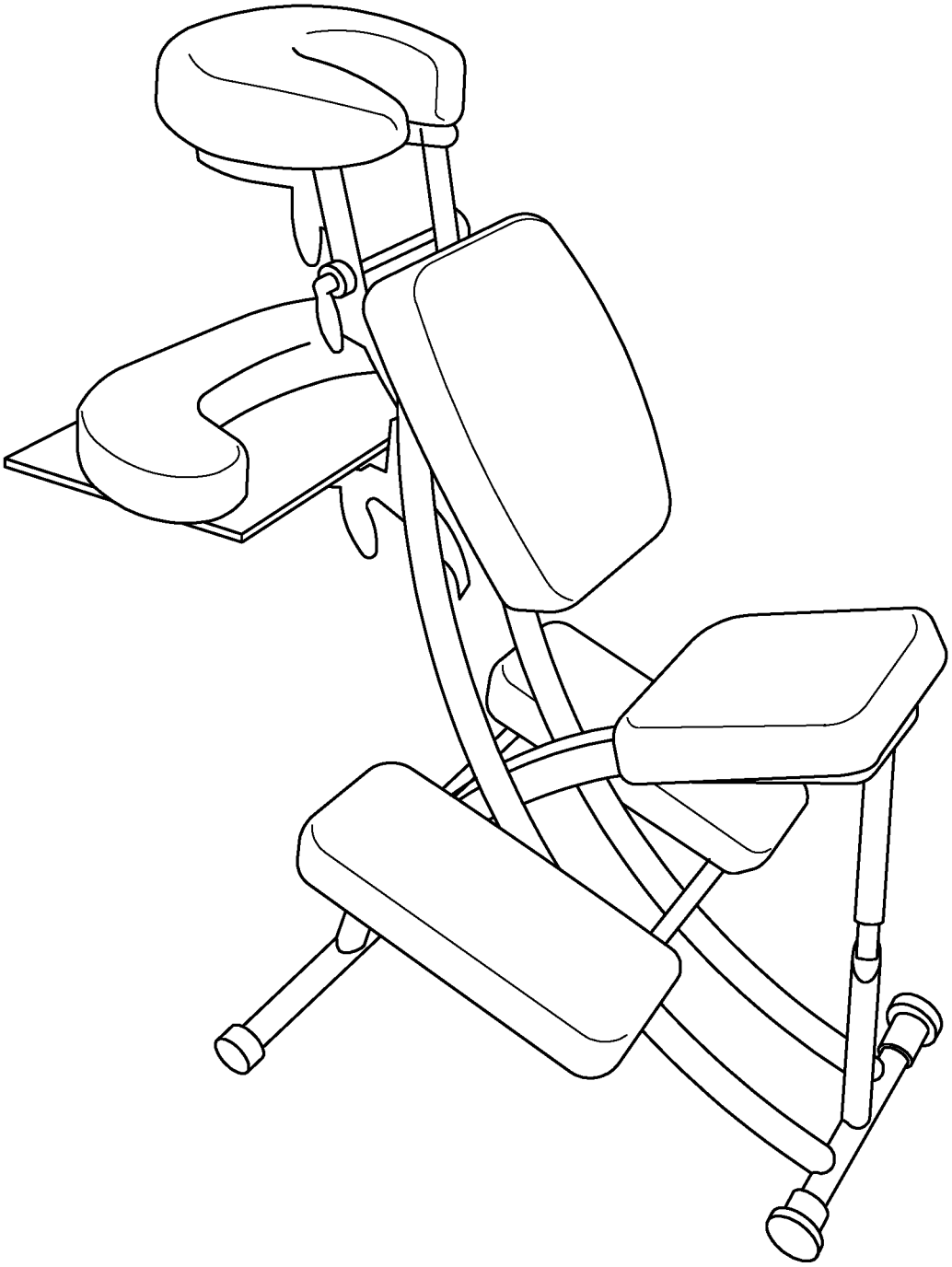
FIG. 9 (Prior Art)
FIG. 9 is a prior art semi prone sitting massage chair.
Figure 10:
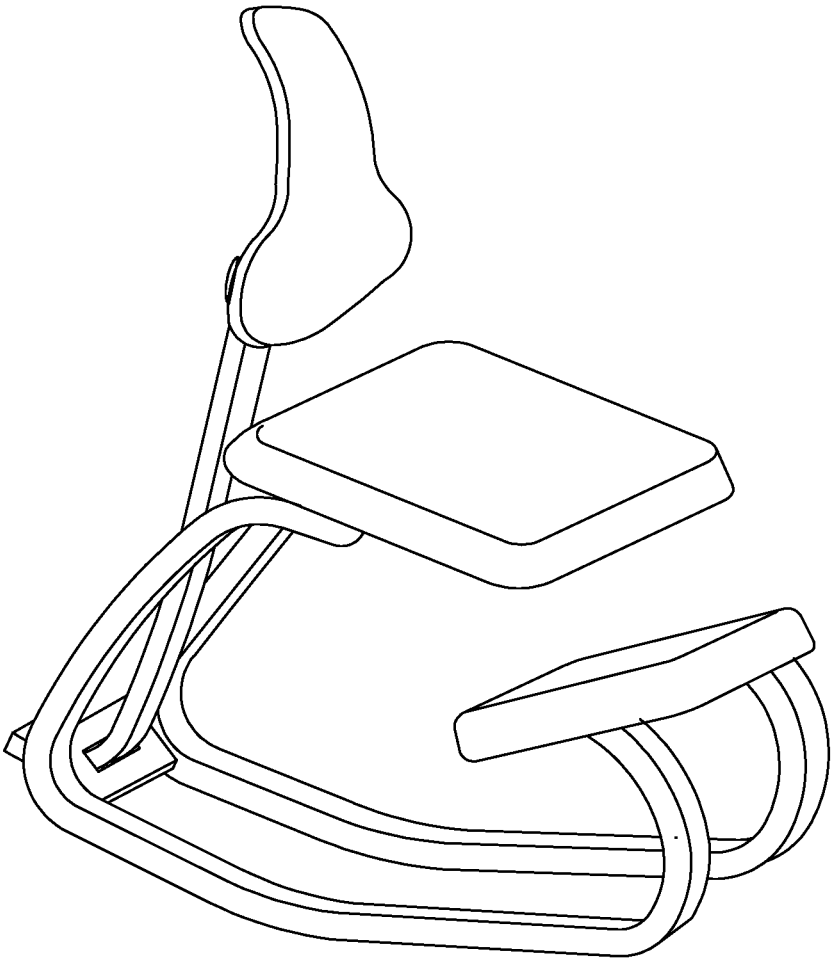
FIG. 10 (Prior Art)
FIG. 10 is a prior art kneeling chair.
Figure 11:
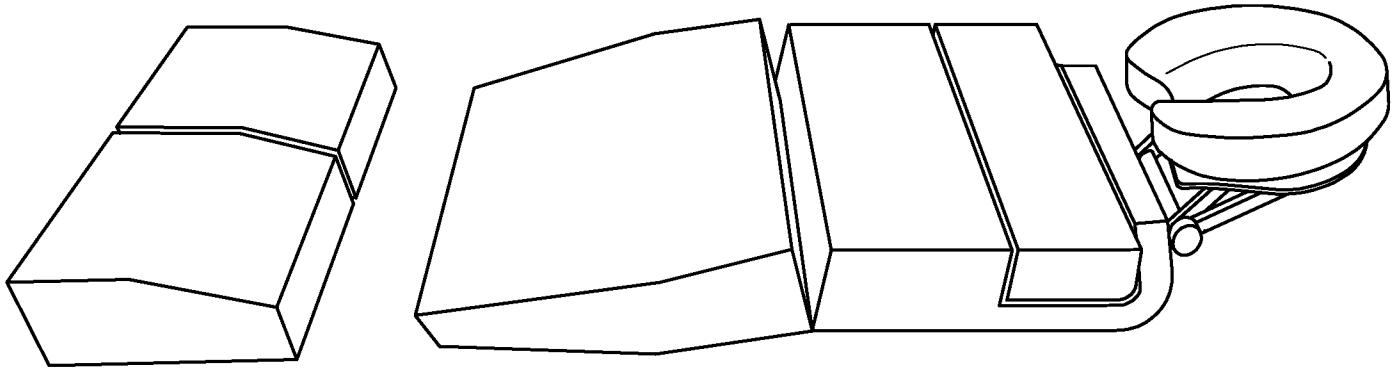
FIG. 11 (Prior Art)
FIG. 11 is a prior art fully prone massage table.

Referring now to the drawings, FIG. 9-11 represent three conventional seating/support devices in the form of a kneeling type massage chair, a kneeling office chair, and a support surface with a head support for fully prone recline. As noted above, the challenges associated with standing-based solutions, and conventional seating, kneeling-type solutions and fully-prone reclined solutions include a variety of well described physical and physiological disadvantages. Thus, at best, such devices address only some of the disadvantages of conventional upright seating and standing.

The teachings of the instant disclosure overcome deficiencies in the art. In particular, in some embodiments, the prone body support apparatus establishes the user in a prone position with a unique configuration providing three-point fixation of the user's body on supports that contact and support, respectively, the buttock, front of each thigh, and three-point fixation with the pads on the buttock, front of the thigh, and the feet that allows for minimized lumbar intradiscal pressure. The inventive prone body support apparatus is especially advantageous in minimizing the pressure experienced on the spine, reducing or eliminating the impact of the head weight on the spine, reducing stress on the wrists, and arranging the user's pelvis and legs in a position that enables active engagement of the major muscles of the buttocks and legs. And in particular, the relative placement of the knee-adjacent thigh, posterior and foot bracing places the ankles in slight dorsiflexion stretch, allowing for a closed kinetic chain contraction of the glutes, quads, and gastrosoleus which is difficult if not impossible during sitting.

Definitions

The term "prone body support apparatus" described herein is defined as a moveable device intended to support various human activities, such as, seating (e.g., a chair, a stool, a bench), working (e.g., a desk, a workstation, a table, a work surface), and resting (e.g., bed, massage chair, massage table). Prone body support apparatus is also defined as a moveable device configured to hold a portable device (e.g., a laptop, a tablet, a smartphone, an e-reader, a handheld gaming device, a small television, etc.) at a viewing position, so long as the user can create an efficient area to work and/or view a display of the portable device.

The term "prone" described herein is defined as sitting and leaning face down on the prone body support apparatus ranging from an almost upright position to a more forward and flat position.

Prone Body Support Apparatus:

Referring again to the drawings, FIG. 1 is a perspective view of an adjustable prone body support apparatus 10 in its operating position, in accordance with an embodiment. In the example embodiment shown, the operating position is substantially horizontal such that a user's body is in a prone position resting substantially flat (i.e., a back of the user is facing upwards and substantially horizontal to a floor). In some embodiments, the operating position in "substantially horizontal" can be defined as the prone body support apparatus 10 being at an angled, for example, in a range from about 0-30 degrees, or from about 20-24 degrees with respect to a floor. The prone body support apparatus 10 includes secondary frame 100 and a primary frame 120 and a base 200 that can be either fixedly attached, or in some embodiments that can be separated from each other. According to such embodiments, the secondary frame 100 and a primary frame 120 and the base 200 can be disassembled and taken apart and later assembled for use. The secondary frame 100 and a primary frame 120 and the base 200 may be made from a light structural metal material, such as, for example, aluminum, or carbon fiber. It should be appreciated that other metal materials, such as, but not limited to, steel, alloy steel, carbon steel, wood, composites, or rigid plastics, etc., may be used. It should further be appreciated that the secondary frame 100 and a primary frame 120 and/or the base 200 may be formed from different materials. For example, the secondary frame 100 and a primary frame 120 may be formed from aluminum and the base 200 may be formed from steel to provide stronger structural integrity acting as a base. In one embodiment, the secondary frame 100, primary frame 120 and the base 200 can be constructed from rods, tubes, bars, including, but not limited to square or rectangular solid materials or hollow tubing.

Figure 3:
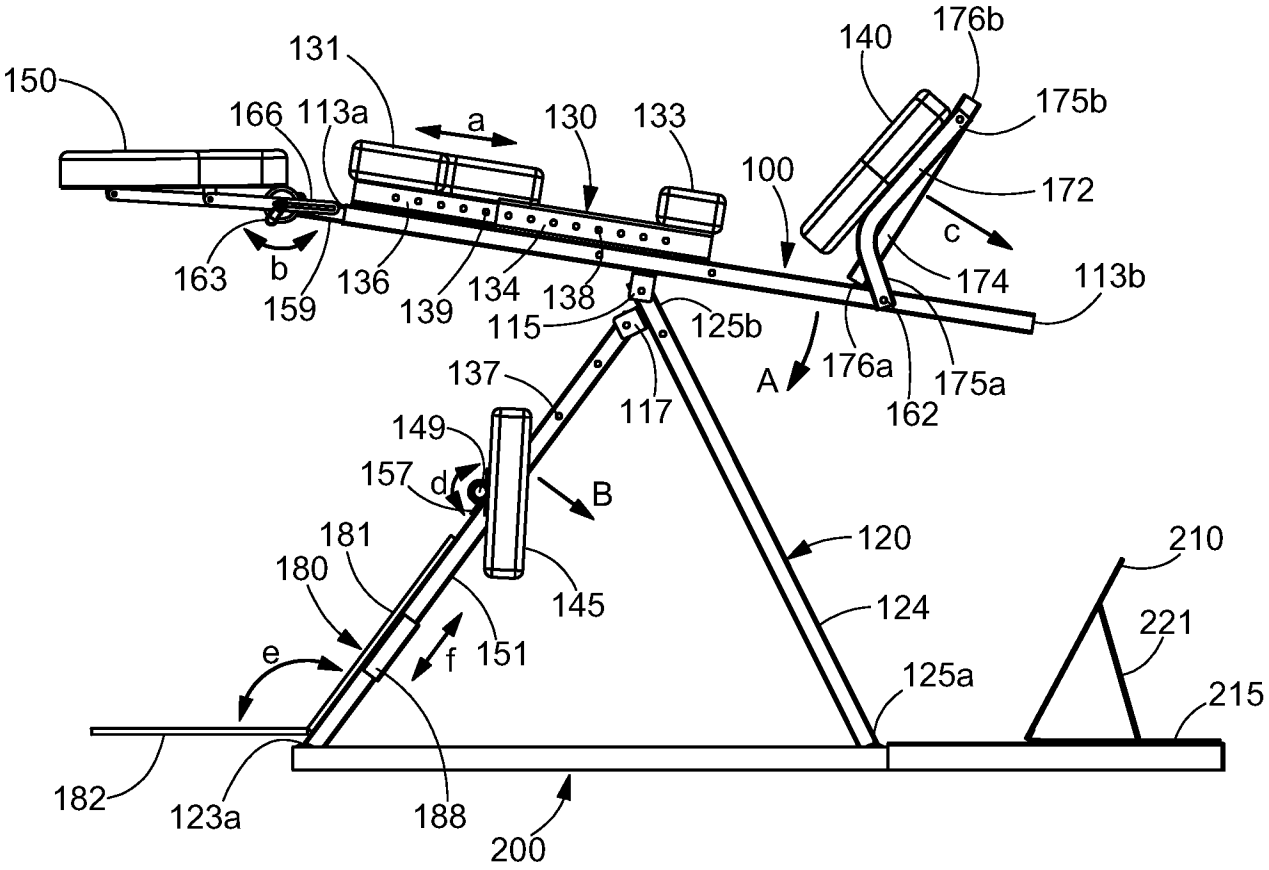
FIG. 3 is a side view of the prone body support apparatus of FIG. 1, according to an example embodiment of the present disclosure.

In some embodiments, the secondary frame 100 and the primary frame 120 are connected at or within a center portion between first and second ends of the secondary frame 100 via a primary frame connector 115 (as shown, e.g., in FIG. 3). According to the depicted embodiment, the primary frame connector 115 connects the secondary frame 100 and the primary frame 120 together and is configured to allow the secondary frame 100 to move towards the primary frame 120, as shown by arrow A in FIG. 3. In one embodiment, the primary frame connector 115 is attached to the secondary frame 100 at a mid-portion of the primary frame connector 115 via welding. Other methods may be used to connect the primary frame connector 115 to the secondary frame 100 such as, but not limited to, hardware assembly (e.g., screw and bolt), spot welding, riveting, brazing, and/or soldering. Thus, at the point of attachment of the secondary and primary frames, the fixation may be ridged, releasable and non-adjustable, or adjustable, or releasable and adjustable. In some embodiments, the secondary frame 100 can move (rotate) with respect to the primary frame 120 in various positions via rotation, for example, around the primary frame connector 115, acting as a fulcrum, and locked in position via a locking device (e.g., a pin) (not shown). For example, in use, the secondary frame 100 can rotate to a substantially horizontal position (even slightly beyond horizontal); and in a stored configuration, the secondary frame 100 can rotate until the secondary frame 100 is parallel with the primary frame 120. In some embodiments, the secondary frame 100 can have a range of rotation with respect to the primary frame 120 of approximately 0 to 45 degrees or greater, for example, from a stored position to an operating position. In a further embodiment, the secondary frame 100 can rotate beyond the substantially horizontal operating position (i.e., rotating in an opposite direction of arrow A), having a rotation angle of approximately 0 to 100 degrees. Of course, in some embodiments, the secondary 100 and primary 120 frames are fixedly engaged.

In some embodiments, the secondary frame 100 and the primary frame 120 can be attached together by a tension cable (not shown) to apply a force to keep the secondary frame 100 and the primary frame 120 apart from each other. In some embodiments, one end of the tension cable may be attached to a portion of the secondary frame 100 and the other end of the tension cable can be attached to a portion of the primary frame 120 to create a pull force to maintain a distance between the secondary frame 100 and the primary frame 120.

The secondary frame 100 includes a head support 150, a torso support 131 and a hip support 133, a posterior brace 140. In some embodiments, one or more of the supports may include a pad. The secondary frame 100 includes a first end portion 113*a* and a second end portion 113*b*, opposite the first end portion 113*a*. In one embodiment, the head support 150 is located near the first end portion 113*a* and the posterior brace 140 is located near the second end portion 113*b*.

In some embodiments, the head support 150 and torso support 131 are integrated as an integrated upper body support 130 that is disposed on the secondary frame 100. In some embodiments, the integrated upper body support 130 can be attached to the secondary frame 100 via a fastener, such as, for example, a clamp screw, a pin, a screw and bolt, u-bolts, j-bolts, etc., in which the integrated upper body support 130 can be configured to move along the secondary frame 100 to adjust for different sized users. In other embodiments, the integrated upper body support 130 can be permanently attached to the secondary frame 100 via welding, for example. In some embodiments, the posterior brace 140 is pivotally connected to the secondary frame 100 via a pin (not shown) inserted in an pin receiver 162 formed in the secondary frame 100. In other embodiments, other fixation means may be used. The head support 150 is connected to the secondary frame 100 via an elongate support 159 that is inserted into the first end portion 113*a* of the secondary frame 100 and configured to slide inside of the secondary frame 100. This enables the head support 150 to adjust to a particular size of the user, i.e., a distance between a head and a chest of the user. The elongate support 159 should have a similar shape as the secondary frame 100 to be inserted therein. According to such embodiments, the elongate support 159 and the secondary frame 100 has a male-to-female type connection. In one embodiment, the elongate support 159 is square shaped, corresponding to a similar shape of the secondary frame 100.

In some embodiments, the integrated upper body support 130 includes a hip frame 134 that supports the hip support 133 and a torso frame 136 that supports the torso support 131. The torso frame 136 may be moveable with respect to the hip frame 134, as indicated by arrow a in FIG. 3. Thus, in some embodiments, the torso frame 136 is inserted into the hip frame 134 and slidably adjusted to accommodate for the different body sizes of the user. In particular, the hip frame 134 and the torso frame 136 adjust a distance between the chest and pelvic regions of a particular user (i.e., different length of torsos) to optimize supporting the weight of the user and avoid blood flow restriction and/or nerve impingement. According to some embodiments, to adjust, the hip frame 134 includes a plurality of fixation apertures 138 and the torso frame 136 includes a plurality of fixation apertures 139 that are configured to correspondingly engage with the plurality of fixation apertures 138. In use, the user may adjust the distance between the hip frame 134 and the torso frame 136, which supports the hip support 133 and the torso support 131, respectively, by aligning the plurality of apertures 138, 139 and inserting a pin (not shown) to secure the hip frame 134 and the torso frame 136 in place. It should be appreciated that more than one pin may be inserted in the plurality of apertures 138, 139 for added securement (i.e., the hip and torso frames 134, 136 from moving). It should further be appreciated that other securing devices may be employed, such as, for example, metal ball mounted bearings.

In some embodiments, the hip frame 134 is substantially rectangularly "U" shaped and the torso frame 136 is similarly substantially rectangularly "U" shaped. In one embodiment, the hip and torso frames 134, 136 include a horizontal and two vertical portions, each extending from ends of the horizontal portion. In view of the rectangularly "U" shaped configuration, the hip frame 134 is in an inverse position with respect to the torso frame 136 forming a box-like shape. Other shapes may be employed as long as the hip and torso frames 134, 136 support the respective hip support 133 and torso support 131 and can slidably engage with each other.

In some embodiments, the torso support 131 is designed to receive the chest of the user and can accommodate for various sized users (i.e., chest girth sizes). In the example embodiment shown in FIG. 1, the torso support 131 extends substantially the same width as the integrated upper body support 130, more specifically, the torso frame 136. While the size of this torso support 131 may accommodate most users, it should be appreciated that different size torso supports, dependent upon sex, weight, size, can be employed. In some embodiments, the torso support 131 can be removed and replaced with another torso support having a different size and/or shape. It should be appreciated that the width of the torso support 131 should not impact the ability to use or operate the work object. In some embodiments, the width of the torso support 131 should permit the upper arms of the user to have sufficient room to operate the work object.

Figure 5:
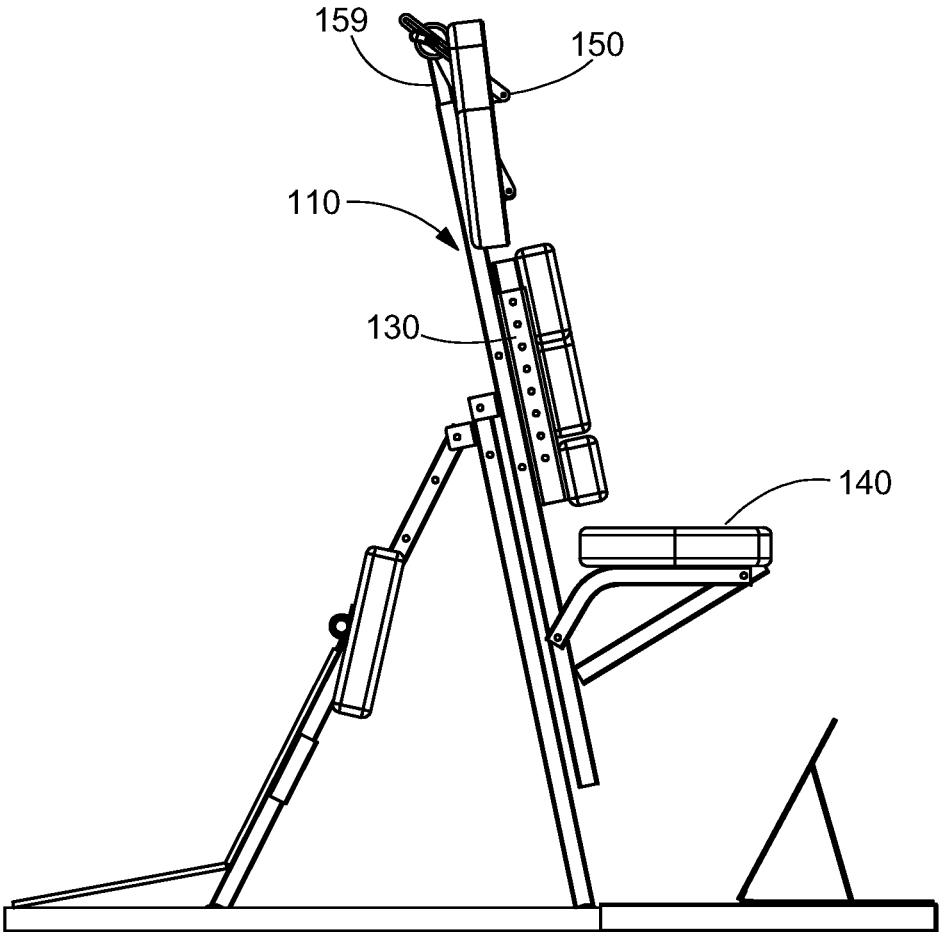
FIG. 5 is a side view of a prone body support apparatus in an upright position in a compressed state, according to an example embodiment of the present disclosure.
Figure 6A:
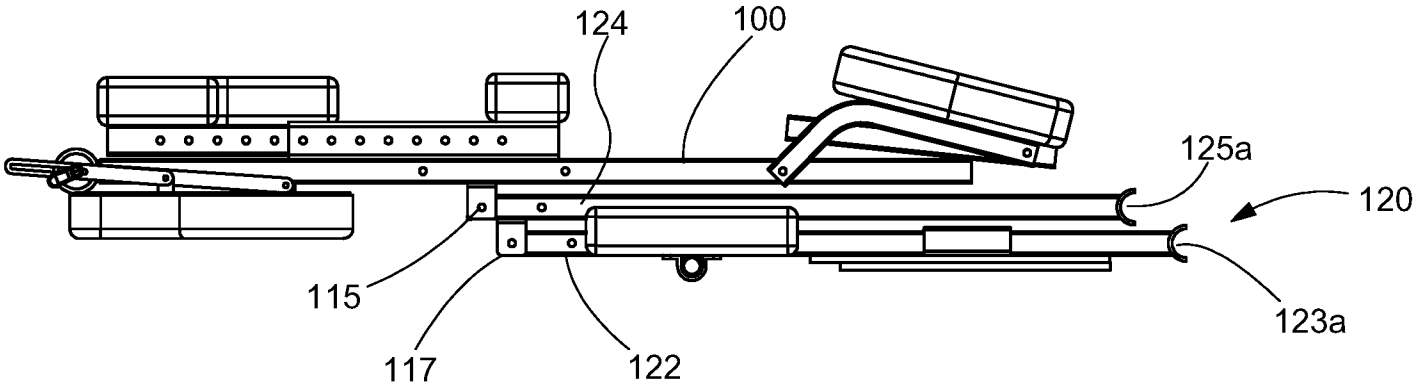
FIG. 6A is a side view of a prone body support apparatus in a folded position, according to an example embodiment of the present disclosure.

The head support 150 is configured to pivotally rotate with respect to the elongated support 159 via a rod 161, as shown by arrow b in FIG. 3. The rod 161 extends through the head support 150 (and the elongated support 159) to permit the head support 150 to pivotally rotate. The head support 150 can be configured to rotate. In various embodiments, the rotation may be in arrange from about 1 to about 180° in a first direction (i.e., clockwise), and may also be configured to rotate from about 1 to about 180° in a second direction (i.e., counter-clockwise) opposite the first direction. In the first direction, a first surface (i.e., a surface facing a face of the user) of the head support 150 can move towards the secondary frame 100 (as shown in FIG. 5), and in the second direction, a second surface (i.e., a surface facing away from the face of the user), opposite the first surface, can move towards the secondary frame 100 (as shown in FIG. 6A). In some embodiments, the head support 150 can be configured to pivotally rotate around the rod 161 in from about 1 to about 180° in either direction. This enables adjustability at an angle at which the user wants the head support 150 and locked in position, and in addition, the ability to stow/store the prone body support apparatus 10. The head support 150 has a viewing aperture 153 large enough to prevent obstruction of a viewing area of a display on the work object and to allow for full use and exposure of the eyes. Similarly, the head support 150 for receiving the face of the user has a viewing aperture 153. In one embodiment, the head support 150 has a generally ring-shaped design (e.g., circular or oval) provided with a central opening to provide user viewing access to the computer device while positioned on the head support 150. It should be appreciated that other shapes may be employed for the design of the head support 150, such as, for example, a semi-circular. Further, the head support 150 may adjust for different head sizes. In some embodiments, the head support 150 can be adjusted to adjust for a width of the user's head. In one embodiment, head support 150 may be constructed as a two-piece that is moveable rotationally and along a central axis that generally corresponds with the axis of the spine of a user when positioned on the prone body support apparatus. In some embodiments, the head support may be width adjustable to adjust for the width of the user's head.

In one embodiment, the rod 161 can be an elongated screw clamp with a clamping fastener 163 at each end of the rod 161 to hold (lock) the head support 150 in place against the elongated support 159. The clamping fastener 163 can be, such as, but not limited to, a knob screw, a clamping knob, a hand knob, a star knob, a wing nut, a bar-handle, a clamping screw, etc. For finer adjustment, the head support 150 can be adjusted for further movement (i.e., in a direction that is parallel to the elongated support 159). This ensures that the user's viewing area is not obstructed. In one embodiment, the head support 150 can move via a slot 166 formed in the head support 150, constituting a pin-slot joint. In some embodiments, slots 166 can receive the respective end portions of rod 161 which can slide therein for movement of the head support 150. Once the head support 150 is properly positioned, the head support 150 is locked in position by tightening the clamping fastener 163. Hence, the head support 150 is adjustable in with respect to the elongated support 159.

The posterior brace 140 which may further include a pad includes a first bracket 172 and a second bracket 174. The first bracket 172 includes a first end portion 175*a* and a second end portion 175*b*, opposite the first end portion 175*a*. The second bracket 174 includes a first end portion 176*a* and a second end portion 176*b*, opposite the first end portion 176*a*. In some embodiments, the first bracket 172 pivotally rotates at the first end portion 175*a* to move the posterior brace 140 closer to the secondary frame 100 during non-use of the prone body support apparatus 10 (i.e., folded configuration). The second bracket 174 pivotally rotates at the second end portion 176*b* to adjust for the height of the posterior brace 140, as shown by arrow c in FIG. 3, and fastened the first end portion 176*a* to the secondary frame 100. This ensures proper adjustment of the abdomen area of the user, which may include the abdomen, hip, pelvic, and buttock. In one embodiment, the second end portion 176*b* includes a notch to corresponding engage with a toothed notch (not shown) on the secondary frame 100 near the second end portion 113*b* to tightly secure the posterior brace 140 against the secondary frame 100. In some embodiments, there is a plurality of tooth notches on the secondary frame 100 to adjust the posterior brace 140.

The primary frame 120 includes a first leg 122 and a second leg 124. The first leg 122 includes a first end portion 123*a* and a second end portion 123*b*, opposite the first end portion 123*a*. The first end portion 123*a* of the first leg 122 can be constituted as a base end that is configured to be attached to the base 200. Similarly, the second leg 124 includes a first end portion 125*a* and a second end portion 125*b*, opposite the first end portion 125*a*. The first end portion 125*a* of the second leg 124 can be constituted as a base end that is configured to be attached to the base 200. In one embodiment, the first end portions 123*a*, 125*a* have a curved configuration (as shown in FIG. 6A) so as to engage and attach to the base 200. This ensures that the secondary frame 100 and the primary frame 120 are firmly secured to the base 200 by forming a triangular shaped support structure. It will be appreciated that additional supports or legs may be added to supplement the support from the first and second legs 122,124.

The first leg 122 and the second leg 124 are connected to each other at a fixed point via a leg connector 117 (as shown in FIG. 3). The leg connector 117 connects the first leg 122 and the second leg 124 together and is configured to allow the first leg 122 to move towards the second leg 124, as shown by arrow B in FIG. 3. More specifically, the second end portion 123*b* of the first leg 122 is pivotally connected to the leg connector 117. In some embodiments, the leg connector 117 is attached to the second leg 124 near the second end portion 125*b* via welding, for example. Other methods may be used to connect the leg connector 117 to the second leg 124 such as, but not limited to, hardware assembly (e.g., screw and bolt), spot welding, riveting, brazing, and/or soldering. In some embodiments, the leg connector 117 can include a ratcheting mechanism to move the first leg 122 towards the second leg 124 while locking the first leg 122 in place. That is, the ratcheting mechanism requires a force (in a first direction) to move the first leg 122 towards the second leg 124 and locks it in place while concurrently preventing the first leg 122 from moving away (opposite the first direction) from the second leg 124. In order to permit the first leg 122 to move away from the second leg 124, the first leg 122 moves past the farthest locked position which will then release the tension and permit movement away from the second leg 124.

Figure 2:
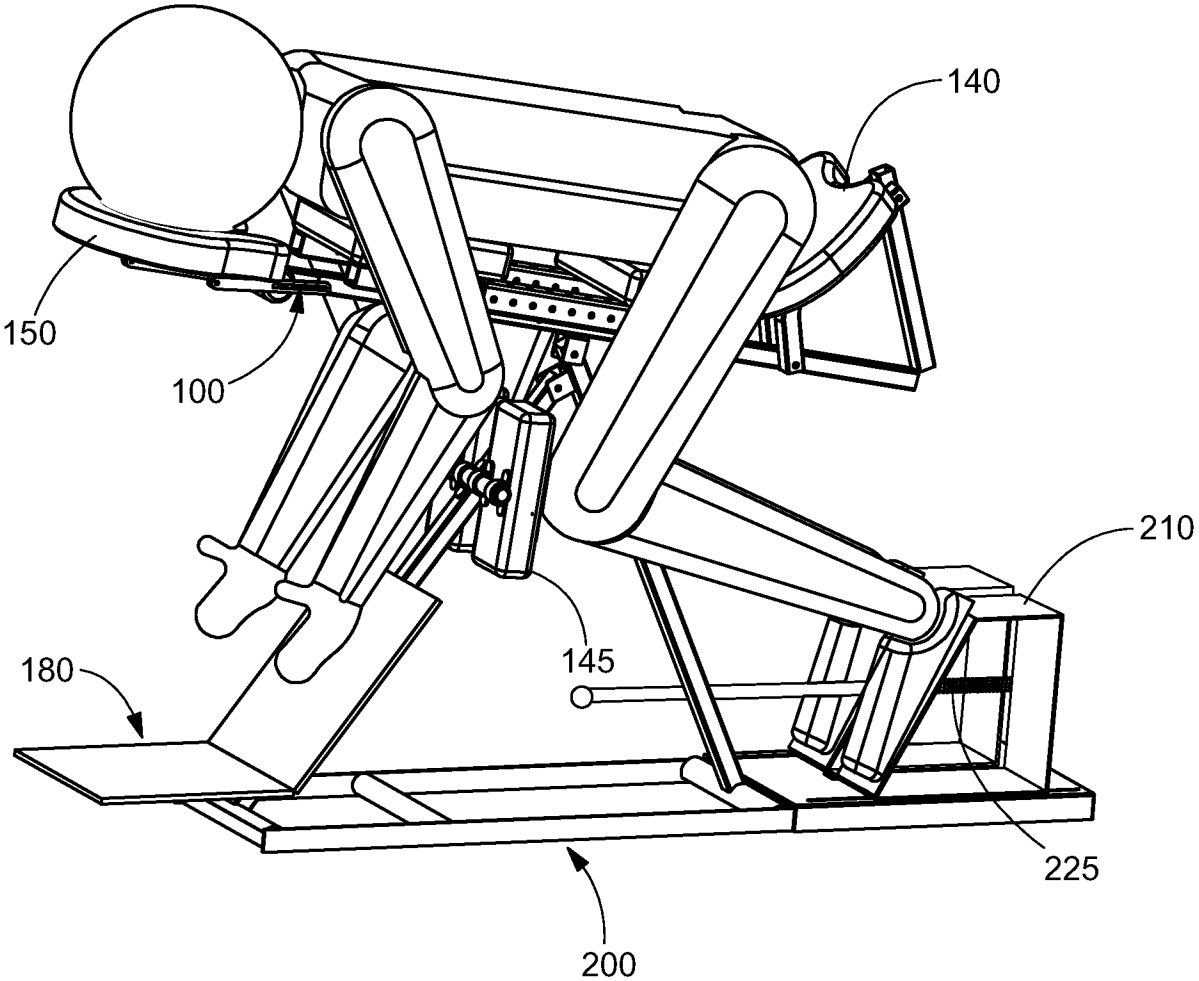
FIG. 2 is a perspective view of a prone body support apparatus in use by a user, according to an example embodiment of the present disclosure.

Further, the primary frame 120 includes a knee-adjacent thigh brace 145 connected to the first leg 122. Referring now to FIG. 2, the knee-adjacent thigh brace 145 is oriented in a generally perpendicular orientation relative to the base or surface on which the base rests. According to the depicted configuration of the knee-adjacent thigh brace 145, the user's thigh adjacent the knee contacts the knee-adjacent thigh brace 145 and enables flexion of the user's knee to about 90 degrees, as shown. In one embodiment, the knee-adjacent thigh brace 145 is pivotally connected to the first leg 122 via a rod 149, and is configured to rotate, as shown by arrow d in FIG. 3. In use, the user applies slight pressure against the knee-adjacent thigh brace 145 to rotate the knee-adjacent thigh brace 145 in a first direction or a second direction to allow the user to move their legs. Additionally, the knee-adjacent thigh brace 145 ensures that there is support on the knees to prevent the legs from hanging freely, which can cause improper blood circulation to the lower extremities. In some embodiments, the knee-adjacent thigh brace 145 can be connected to the first leg 122 with a ratcheting mechanism to move the knee-adjacent thigh brace 145 in a first direction (e.g., clockwise) and locks the knee-adjacent thigh brace 145 in place, while concurrently preventing the knee-adjacent thigh brace 145 from moving in a second direction (e.g., counter-clockwise). That is, the ratcheting mechanism requires a force to move the knee-adjacent thigh brace 145 in a clockwise direction but prevents the knee-adjacent thigh brace 145 from moving in a counter-clockwise direction. The ratcheting mechanism has multiple positions to lock the knee-adjacent thigh brace 145 in its place at various positions. In order for the knee-adjacent thigh brace 145 to move in the counter-clockwise direction, the knee-adjacent thigh brace 145 moves past the farthest locked position (in the clockwise direction) such that the ratcheting mechanism releases an applied tension and permits movement in the counter-clockwise direction.

In some embodiments, a plurality of brackets 157 can be used to hold the rod 149 to the first leg 122 and the knee-adjacent thigh brace 145 while the rod 149 freely rotates about its axis. For example, one bracket can be used to attach the rod 149 to the first leg 122 and two brackets can be used to attach the rod 149 to each knee-adjacent thigh brace 145. It should be appreciated that more or less brackets can be used to attach the rod 149 to the first leg 122 and the knee-adjacent thigh brace 145. It should further be appreciated that the plurality of brackets 157 merely hold the rod 149 in place while permitting the rod 149 to freely rotate about a fixed axis.

In some embodiments, the knee-adjacent thigh brace 145 can be moved along the first leg 122 to accommodate for various size user (e.g., leg length). For example, using a pin-opening connection, the first leg 122 can have a plurality of fixation apertures 137 to move the knee-adjacent thigh brace 145 along the first leg 122 and adjust the height of the knee-adjacent thigh brace 145, and secure the knee-adjacent thigh brace 145 using a pin. This ensure that proper distance between the knee-adjacent thigh brace 145 and the torso support 131 is provided, i.e., account for femur length of the user's leg.

As shown variously in the drawings, according to the depicted embodiments, the knee-adjacent thigh brace 145 is attached on the primary frame 120. In other embodiments, the knee-adjacent thigh brace 145 can be attached to the secondary frame 100 and extend in an orientation suitable to contact the knee-adjacent thigh area of the user's legs.

The primary frame 120 further includes a media emplacement 180 connected to the first leg 122 for placing a work object (not shown) for operation. In other embodiments, the media emplacement 180 may be connected to the base, or it may be releasably connectable to one or the other of the base 200 or the primary frame 120. The media emplacement 180 includes a first media support portion 181 and a second media support portion 182 that are connected to each other via a hinge, for example. The second media support portion 182 is configured to move (rotate) with respect to the first media support portion 181, as shown by arrow e in FIG. 3. In one embodiment, the first media support portion 181 is attached to the first leg 122 and the second media support portion 182 moves (rotates) toward the first media support portion 181. For example, the second media support portion 182 can rotate approximately from 0° to 135°, while the first media support portion 181 remains attached to the first leg 122. It should be appreciated that the range of rotation of the second media support portion 182 is dependent upon the position of the first leg 122. In one embodiment, the media emplacement 180 is in a closed position when the second media support portion 182 is rotated towards the first media support portion 181 and attached to the first media support portion 181. In view of the rotational feature, the second media support portion 182 allows the user to adjust the viewing distance from the headrest pad 151. That is, the rotating second media support portion 182 provides optimized eye screen angles to maintain a straight ahead gaze. As such, this avoids discomfort and/or injury relating to cervical flexion/extension, as well as headaches and migraines related to strain in the neck, for example.

In some embodiments, a hinge assembly (not shown) may be employed between the first media support portion 181 and the second media support portion 182. The hinge assembly can lock the second media support portion 182 in place at various rotational angles using a friction hinge, for example. The hinge assembly can also have different levels of torque to move the second media support portion 182 towards or away from the first media support portion 181. For example, for a heavier work object, such as a computing device, a stronger torque is required to move the second media support portion 182, while for a lighter work object, a lighter force is required to move the second media support portion 182.

For further adjustment of the media emplacement 180, the first media support portion 181 can be moved with respect to the first leg 122, as shown by arrow fin FIG. 3. According to such embodiments, the first media support portion 181 can move along a surface portion of the first leg 122. This adjustment optimizes the positions of the hands so as to maintain a neutral wrist position for reducing and/or preventing carpal tunnel syndrome, for example. In one embodiment, the movement of the first media support portion 181 can be adjusted to various positions by attaching a fastener 188 (e.g., a hook-and-loop fastener) to the first media support portion 181 and corresponding fastener on the first leg 122. This permits for easy removal of the first media support portion 181 from the first leg 122 and adjusting the position of the first media support portion 181 along the surface of the first leg 122. It should be appreciated that other fasteners may be employed, such as, but not limited to, adhesive, tape, screw and bolt, screw clamp, anchors, rivets, etc.

In some embodiments, the media emplacement 180 may include a third portion (not shown) for holding peripheral devices of the work object (e.g., a mouse, a keyboard, a speaker, a telephone, a trackball, a monitor, etc.). The third portion can be any size to accommodate a small object, such as, a mouse, to a large object, such as a second work object. The third portion can be attached to the first media support portion 181 and/or the second media support portion 182 using conventional means.

In other embodiments, on a surface of the second media support portion 182, apertures may be formed for removing heat generated by the work object. In other embodiments, the surface of the second media support portion 182 can include an anti-slip material to reduce and/or prevent the work object from sliding off the second media support portion 182. In other embodiments, the media emplacement 180 may include a power outlet for a power cord of the computer device On the base 200, a foot brace 210 is attached thereto. More specifically, the foot brace 210 is attached to a platform 215 via fasteners 213 (e.g., screws), which is attached to the base 200. In some embodiments, the platform 215 is attached to the base 200 via fasteners 217 (e.g., screws) that are inserted into corresponding fastener receivers 218 formed in the platform 215. In one embodiment, the platform 215 (and/or the foot brace 210) can be made from a metal material, such as, for example, steel, for structural integrity. Besides the inherent characteristics of steel for structural strength, steel material can also reduce any force (or torque) that is applied by the user.

The foot brace 210 is configured to be moveable with respect to the platform 215. In one embodiment, the platform 215 includes a plurality of fixation apertures 219 to receive a brace angle adjuster 221 of the foot brace 210. In some embodiments, one end of the brace angle adjuster 221 is attached to the foot brace 210 and the other end is freely movable that can be inserted into one of the plurality of fixation apertures 219 for adjustability. According to such embodiments, an angle of the foot brace 210 can be adjusted by moving the brace angle adjuster 221 into one of the plurality of fixation apertures 219. This permits the user to adjust a length between the knee-adjacent thigh brace 145 and the foot brace 210, i.e., account for calf bone length of the leg. This also permits slight movement of the legs such that blood circulation to the lower extremities is provided. In some embodiments, the foot brace 210 can move using a ratcheting mechanism to move the foot brace 210 in a first direction and lock the foot brace 210 in place, while concurrently preventing the foot brace 210 from moving in a second direction (i.e., opposite the first direction). That is, the ratcheting mechanism requires a force to move the foot brace 210 in one direction but prevents the foot brace 210 from moving in the opposite direction. The ratcheting mechanism has multiple positions to lock the foot brace 210 in its place at various positions. In order for the foot brace 210 to move in the opposite direction, the foot brace 210 moves past the farthest locked position (in the first direction) and releases an applied tension to permits movement in the opposite direction.

In use, while applying a force on the foot brace 210, the user can apply pressure against the knee-adjacent thigh brace 145 to rotate the knee-adjacent thigh brace 145 in a first direction or a second direction for adjustment and allow the user to slightly move their legs including performing exercises that contract the gluteal muscles and quadriceps, for example. This ensures proper blood circulation to the lower extremities and/or prevent sedentary behaviors. Further, in combination with the foot brace 210 and the knee-adjacent thigh brace 145, the posterior brace 140 can be used to create a three-point fixation and ensure that stability is provided to the user when using the prone body support apparatus 10. According to such embodiments, the body parts (i.e., buttocks, knees/thighs, foot) that engage the respective posterior brace 140, knee-adjacent thigh brace 145, and foot brace 210 enables fixation points for stability.

In some embodiments, as shown in FIG. 2, the foot brace 210 can include a spring 225 to permit the user to apply resistance force against the foot brace 210. According to such embodiments, the user can move the foot brace 210 back and forth by pushing against the foot brace 210. This also enables adjustability so that different sized users (i.e., length of the calf bone) can fit in this portion of the prone body support apparatus 10. In some embodiments, the spring 225 can be a type that when load is applied, the spring 225 produces an opposing force with a constant rate of change, such as, for example, a linear rate spring. It should be appreciated that other spring can be employed, such as, but not limited to, a compression spring, an extension spring, a torsion spring, and/or a variable rate spring.

In some embodiments, the foot brace 210 can be collapsible (i.e., folded). That is, the foot brace 210 lays flat against the platform 215. In one embodiment, the foot brace 210 can be collapsed by removing the support 221 from one of the fastener receivers 219. In some embodiments, the platform 215 includes slots 229 that enables the foot brace 210 to slide on the platform 215 and permit the foot brace 210 to lay flat against the platform 215. When the foot brace 210 is in the collapsed state, this permits the user to extend their legs and be in a plank position. According to such embodiments, the user is able to stretch their legs and do exercises that contract the gluteal muscles and quadriceps. Additionally, the user is also able to alternate positions between 1) the knees partially bearing the weight along with the pelvic support, 2) stretching both hips and knees and contracting quads/glutes, to 3) alternatively employing a split stance in a 'warrior' pose with one hip and knee extended and the other hip and knee flexed.

Figure 4:
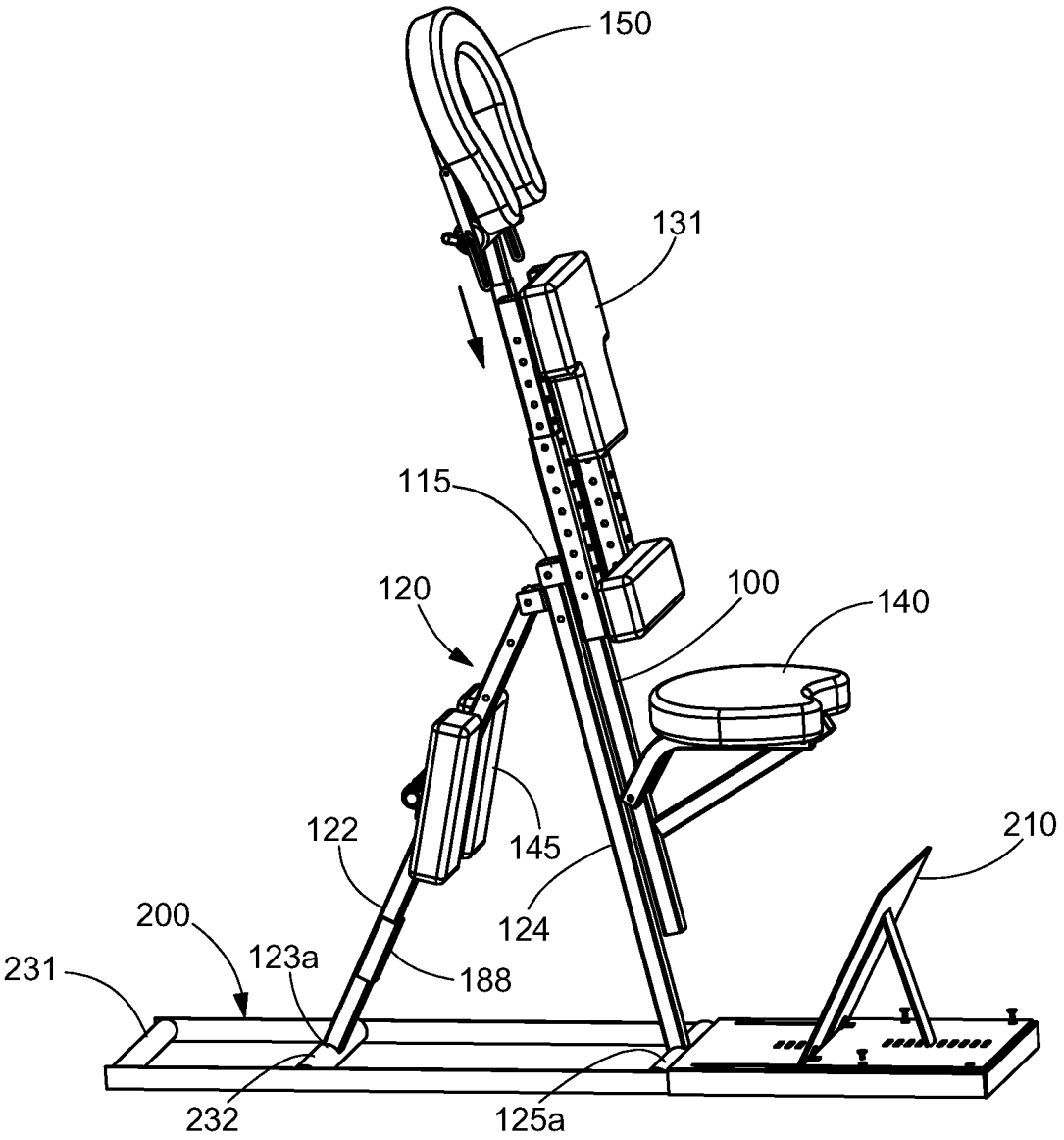
FIG. 4 is a perspective view of a prone body support apparatus in an upright position, according to another example embodiment of the present disclosure.

In some embodiments, as shown in FIG. 4, the prone body support apparatus 10 can be converted to be in an upright position. According to such embodiments, the prone body support apparatus 10 can be converted from a prone position (i.e., back away from the body frame 100) to the upright position (i.e., back against the body frame 100). In the upright position, the user is sitting on the posterior brace 140. This permits the prone body support apparatus 10 for different uses. For example, in the prone position, the user's face may be placed on the head support 150 and receive a shoulder and/or back massage. In the upright position, the user's head may be placed on the head support 150 and receive a facial massage, a leg/foot massage, and/or an arm/hand massage. The user may also place his/her foot on the foot brace 210 while receiving the massages. Alternatively, the prone body support apparatus 10 can be used as a regular chair in the upright position.

In order convert into the upright position from the use position, the secondary frame 100 is pivotally rotated to be parallel with the second leg 124 (i.e., nearly horizontal position). Then, the first leg 122 is moved to a second crossbar 232 from a first crossbar 231 that are formed on the base 200 and locked in place. Due to the first end portion **123*a* of the first leg 122 having the similar shape as the crossbars 231, 232, the first leg 122 is securely locked to the crossbar 232 in the upright position. In one embodiment, the first end portion 123*a* has a semi-circular shape, as shown in FIG. 6A, which corresponds to a shape of the crossbars 231, 232**, i.e., a rod.

FIG. 5 illustrates the prone body support apparatus 10 in a compressed state while in the upright position, in accordance with an example embodiment. In this compressed state, the integrated upper body support 130 is moved towards the posterior brace 140, and the head support 150 is also moved towards posterior brace 140 by sliding the elongate support 159 into the secondary frame 100, which is constructed of a hollow tubing. This exemplary embodiment illustrates the further adjustability features of the prone body support apparatus 10. Further, the head support 150 can be pivotally rotated towards/away from the secondary frame 100. The movement of the integrated upper body support 130 permits for adjustment of the upper body portion of the user while in the upright position. The adjustable movements of the head support 150 permits for adjustment of the position of the neck of the user while in the upright position.

Figure 6B:
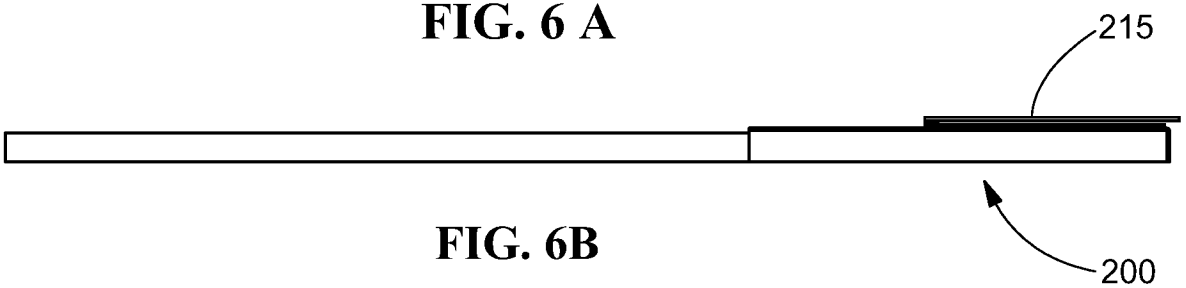
FIG. 6B is a side view of the base of the prone body support apparatus in its folded stage, according to an example embodiment of the present disclosure.

FIGS. 6A and 6B are perspective views of the prone body support apparatus 10 that are separated to be stored. FIG. 6A illustrates the body frame 100 in its folded state; and FIG. 6B illustrates the base 200 in its folded stage. As shown in FIG. 6A, the body frame 100 can be folded by moving (pivotally rotating) the first leg 122 towards the second leg 124 at the leg connector 117, and then moving (pivotally rotating) the second leg 124 towards the secondary frame 100 at the primary frame connector 115. It should be appreciated that other methods may be employed to collapse the prone body support apparatus 10 in its folded state. For example, the user may initially move the secondary frame 100 and then the second leg 124, then the first leg 122.

When in its folded state, the body frame 100 lays on top of the base 200 and can be easily stored for later use. This creates a low height structure that can be easily stored under tight space, such as, for example, under a bed, under a sofa, a closet, a small room, a car, etc. Further, in the folded state, it is easy to transport the prone body support apparatus 10.

In some embodiments, the body frame 100, particularly, the primary frame 120 may include a forearm pad portion (not shown). In one embodiment, the forearm pad portion may be located on the first leg 122 to support the forearms of the user. The forearm pad portion facilitates a neutral shoulder position to reduce and/or prevent injuries, such as, for example, shoulder elevation, scapular retraction, and/or shoulder impingement.

Figure 7:
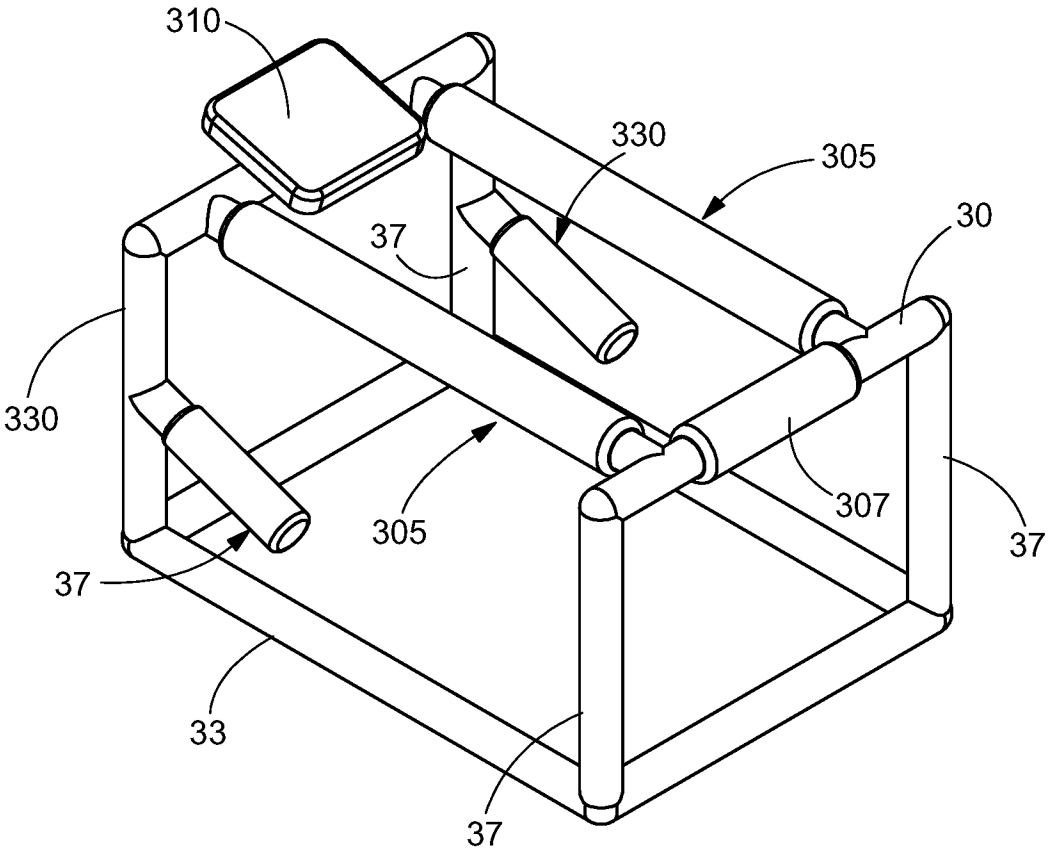
FIG. 7 is a schematic view of a prone body support apparatus, according to another example embodiment of the present disclosure.

FIG. 7 is a schematic view of a prone body support apparatus 20, according to another example embodiment of the present disclosure. The prone body support apparatus 20 is configured to support the back and shoulder and upper extremities while operating a portable work object. In some embodiments, the prone body support apparatus 20 can be constructed from a plastic hollow tubing 30 having a substantially circular cross-section. It should be appreciated that other shapes, such as, for example, a substantially rectangular cross section, can be employed.

The prone body support apparatus 20 includes a primary frame 33 and an secondary frame 35 connected together by four vertical connecting frame portions 37, forming a substantially rectangular box-like shape. In some embodiments, the primary frame 33, the secondary frame 34, and the vertical connection frame portions 37 can be integrally formed as a single integrated form. In other embodiments, there may be slidable or telescoping connections between the primary frame 33, the secondary frame 34, and the vertical connection frame portions 37 allowing them to be adjusted and/or separated from each other. For example, at each corner, a three-way connecting can be employed to connect the primary frame 33, the secondary frame 34, and the vertical connection frame portions 37 together.

In some embodiments, the prone body support apparatus 20 includes a pair of upper body pads 305 for supporting the back and shoulders, a hip support 307 for supporting the pelvic, a head support 310 for supporting the head, a pair of opposing arm supports 330 for supporting the forearms. The upper body pads 305, the hip support 307, and the head support 310, are configured to wrap around the tubing 30 at their respective regions. In some embodiments, the pair of upper body pads 305, the hip support 307, and the head support 310 are disposed on (wraps around) the secondary frame 34. The pair of opposing arm supports 330 can be disposed on the vertical connection frame portions 37. Each of the upper body pads 305, the hip support 307, the head support 310, and the opposing arm supports 330 can be made from a foam material to provide cushion to the user. In some embodiments, the foam can be made from a high-density material, typically made from polyurethane and/or polyethylene, for example.

As shown in FIG. 7, the pair of upper body pads 305 are disposed on the secondary frame 35 of tubing 30 that runs parallel from each other. The upper body pads 305 substantially cover the entire secondary frame 35 of tubing 30 that runs in a longitudinal direction. The hip support 307 and the head support 310 cover a respective portion of the secondary frame 35 of tubing 30 that runs along a central axis that generally corresponds with the axis of the spine of a user when positioned on the prone body support apparatus 20.

In use, the user is in a prone position and the chest and pelvis regions rest on the pair of upper body pads 305 and the hip support 307, respectively, and the head of the user rests on the head support 310, while operating a work object. This enables to distribute the user's weight and relieve pressure of the upper and lower back extremities. In some embodiments, the forearms of the user can rest on the pair of opposing arm supports 330 to support and take the pressure off of the wrist, and therefore, preventing wrist injuries.

In some embodiments, there may be different sized workstation 20 to accommodate users of various size. For example, there may be three sizes (e.g., a small, medium, and large) to accommodate for the different sized users. As an example, based on average sizes of human anatomy, the small workstation may be dimensioned to be 28 inches in length, 12 inches in width, and 17 inches in height; the medium workstation may be dimensioned to be 32 inches in length, 15 inches in width, and 19 inches in height; and the large workstation may be dimensioned to be 36 inches in length, 24 inches in width, and 24 inches in height. It should be appreciated that the dimensions are measured from the end portions of the primary frame 33, the secondary frame 34, and the vertical connection frame portions 37.

In another embodiment of the prone body support apparatus, the apparatus includes a secondary frame and a primary frame attached to a base. The frames may be fixed and not adjustable. In preferred embodiments, the frames are adjustable. The primary frame includes a head support that is adjustable with respect to the primary frame to allow for adjustment of a neck region of a user, a body support that is adjustable with respect to the primary frame to allow for adjustment of a chest region of the user, and a secondary frame that includes a hip support that may be fixed or adjustable with respect to the secondary frame to allow for adjustment of a hip region of the user. In some embodiments, the primary and secondary frame are movably adjustable relative to each other by motion of one or both frames along a long axis of the apparatus from the head toward the hip regions, and in some such embodiments, such adjustability is the means by which one or both of the torso and hips are adjusted. In some embodiments, the apparatus includes opposing arm supports that may be adjustable with respect to the primary or secondary frame to allow for adjustment to support the arms of the user, and a media emplacement that is adjustable with respect to the primary frame to allow for adjustment of a viewing distance of the user.

Figure 8B:
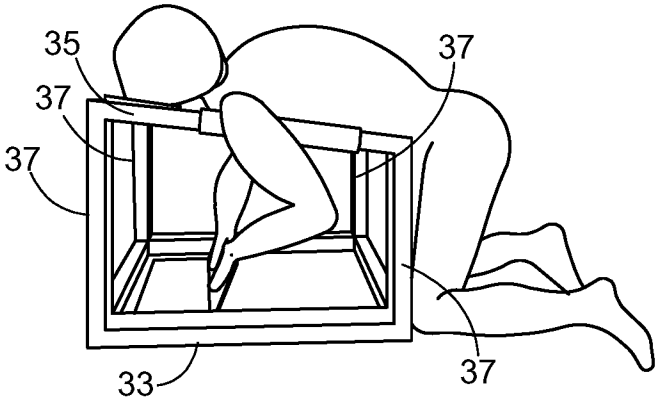
FIG. 8B is another schematic view of the prone body support apparatus in use by a user, according to another example embodiment of the present disclosure.
Figure 8A:
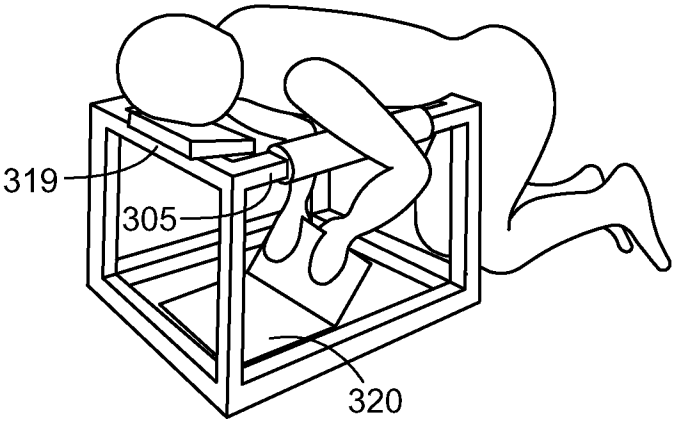
FIG. 8A is a first schematic view of the prone body support apparatus in use by a user, according to another example embodiment of the present disclosure.
Figure 8C:
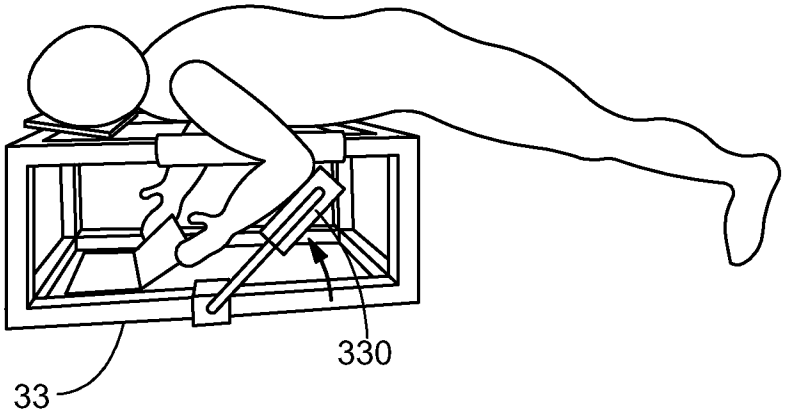
FIG. 8C is another schematic view of the prone body support apparatus in use by a user, according to another example embodiment of the present disclosure.

FIGS. 8A-8C are schematic views of the prone body support apparatus in various use by the user, according to another example embodiment of the present disclosure.

Referring to FIG. 8A, the user is in a prone position operating the work object. While the user's head rests on the head support 310 and chest and pelvis rest on the pair of upper body pads 305, the user's knees rest on the floor to support the lower extremities. In some embodiments, media emplacement 320 may be employed to support the work object (not shown). The media emplacement 320 may be integrally formed with the prone body support apparatus 20, or in the alternative, the media emplacement 320 may be placed on the floor as a separate unit from the prone body support apparatus 20. The media emplacement 320 is similar to the media emplacement 180 and will not be further discussed in detail herein.

In some embodiments, one or both of the primary frame 33 and the secondary frame 35 may be length adjustable, for example by sliding or telescoping expansion of one or the other frame, or by sliding or telescoping expansion of a portion of one frame inserted into a portion of the other frame.

In some embodiments, the secondary frame 35 can be sloped (at an angle) with respect to the primary frame 33, which lies parallel to the floor, as shown in FIG. 8B. This allows for better support angle for the back and alleviates back pressure. In some embodiments, one or both of the primary frame 33 and the secondary frame 35 may be height adjustable, for example by sliding or telescoping expansion of the frame.

Referring to FIG. 8C, the user is depicted in an extended position, i.e., legs stretched to be generally parallel to the floor. This allows the user to move their legs including performing exercises to contract the gluteal muscles and quadriceps. As such, proper blood circulation to the lower extremities is allowed and/or sedentary behaviors is prevented.

In some embodiments, as shown in FIG. 8C, the apparatus includes opposing arm supports 330 can be attached to the primary frame 33 or to the secondary frame 35, or a an interface between the frames to support the forearm, and in some embodiments, the arm supports 330 may include opposing arm supports. In other embodiments, the In some embodiments, the opposing arm supports 330 can include a spring tension to hold the opposing arm supports 330 in place. In other embodiments, the opposing arm supports 330 can include a ratcheting mechanism to move the opposing arm supports 330 and lock it in place. The ratcheting mechanism is similar to the ratcheting mechanism of above and will not be discussed in further detail herein.

The articles "a" and "an," as used herein, mean one or more when applied to any feature in embodiments of the present disclosure described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

"At least one," as used herein, means one or more and thus includes individual components as well as mixtures/combinations.

The transitional terms "comprising," "consisting essentially of" and "consisting of", when used in the appended claims, in original and amended form, define the claim scope with respect to what unrecited additional claim elements or steps, if any, are excluded from the scope of the claim(s). The term "comprising" is intended to be inclusive or open-ended and does not exclude any additional, unrecited element, method, step or material. The term "consisting of" excludes any element, step or material other than those specified in the claim, and, in the latter instance, impurities ordinarily associated with the specified material(s). The term "consisting essentially of" limits the scope of a claim to the specified elements, steps or material(s) and those that do not materially affect the basic and novel characteristic(s) of the claimed disclosure. All materials and methods described herein that embody the present disclosure can, in alternate embodiments, be more specifically defined by any of the transitional terms "comprising," "consisting essentially of," and "consisting of."

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A prone body support apparatus, comprising:

a base and interconnected primary and secondary frames that provide upper body support and lower body three-point fixation to brace body portions that include knee-adjacent thigh portions, a posterior portion, and one or more feet of a user resting on the body support apparatus in a prone position, the base having a generally planar configuration to rest the prone body support apparatus on a surface, the base including a foot brace;

the primary frame supported by the base and having a knee-adjacent thigh brace, the knee-adjacent thigh brace oriented generally perpendicular to the base for contacting the user's thigh;

the secondary frame supported by the primary frame, the secondary frame having, arranged sequentially from a first end to a second end, a head support having a viewing aperture, a torso support, a hip support, and a posterior brace positionable at an angle relative to the head, torso and hip supports, wherein the secondary frame, when in a prone orientation, is oriented in a plane that is parallel to or angled relative to the base, and wherein the posterior brace, the knee-adjacent thigh brace and the foot brace cooperate in supporting the weight of the user resting on the body support apparatus in a prone position to brace each of the knee-adjacent portion of the user's thigh, the user's posterior, and one or more of the user's feet.

2. The prone body support apparatus of claim 1, further including a media emplacement extending from at least one of the base or the primary frame and disposed below the head support, the media emplacement aligned with the viewing aperture of the head support.

3. The prone body support apparatus of claim 2, wherein one or more of the head support, the torso support, the hip support, or a combination thereof are rotatable around or translatable along a long axis from the first and second ends of the secondary frame.

4. The prone body support apparatus of claim 1, wherein one or both of the knee-adjacent thigh brace and the foot brace are movable, enabling movement of the user's legs and flexion of the user's knee to about 90 degrees when the user is positioned on the posterior brace and one or both feet of the user are positioned on the foot brace.

5. The prone body support apparatus of claim 4, wherein the foot brace is one of slidable and collapsible.

6. A prone body support apparatus, comprising:

a base and interconnected primary and secondary frames that provide upper body support and lower body three-point fixation to brace body portions that include knee-adjacent thigh portions, a posterior portion, and one or more feet of a user resting on the body support apparatus in a prone position, the base having a generally planar configuration to rest the prone body support apparatus on a surface, the base including a foot brace;

the primary frame extending from and supported by the base, the primary frame having a knee-adjacent thigh brace that is oriented generally perpendicular to the base for contacting the user's thigh; and the secondary frame extending from and supported by the primary frame, the secondary frame having, arranged sequentially from a first end to a second end, a head support having a viewing aperture, a torso support, a hip support, and a posterior brace positionable at an angle relative to the head, torso and hip supports, wherein the posterior brace, the knee-adjacent thigh brace and the foot brace cooperate in supporting the weight of the user resting on the body support apparatus in a prone position to brace each of the knee-adjacent portion of the user's thigh, the user's posterior, and one or more of the user's feet, and wherein the secondary frame, when in a prone orientation, is oriented in a plane that is parallel to or angled relative to the base, and is rotatable up to about 100 degrees relative to the base when in an upright position, and wherein the prone body support apparatus is reconfigurable from the prone orientation to a collapsed orientation to the upright position.

7. The prone body support apparatus of claim 6, further including a media emplacement extending from at least one of the base or the primary frame and disposed below the head support, the media emplacement aligned with the viewing aperture of the head support.

8. The prone body support apparatus of claim 6, wherein the primary frame is detachable from the base.

9. The prone body support apparatus of claim 6, wherein one or both of the knee-adjacent thigh brace and the foot brace are movable, enabling movement of the user's legs and flexion of the user's knee to about 90 degrees when the user is positioned on the posterior brace and one or both feet of the user are positioned on the foot brace.

10. The prone body support apparatus of claim 9, wherein the foot brace is one of slidable and collapsible.

11. A prone body support apparatus, comprising:

a base and interconnected primary and secondary frames that provide upper body support and lower body three-point fixation to brace body portions that include knee-adjacent thigh portions, a posterior portion, and one or more feet of a user resting on the body support apparatus in a prone position, the base having a first end and a second end, and having at the second end a foot brace, wherein the base has a generally planar configuration to rest the prone body support apparatus on a surface;

the primary frame having first and second legs, each leg extending from and supported by the base, the primary frame having a knee-adjacent thigh brace extending from the first leg and oriented generally perpendicular to the base for contacting the user's thigh; and the secondary frame extending from and supported by the primary frame, the secondary frame having, arranged sequentially from a first end to a second end, a head support extending from the first end, the head support having a viewing aperture, a torso support, a hip support, and a posterior brace extending from the second end and positionable at an angle other than parallel to the head, torso and hip supports, wherein the secondary frame, when in a prone orientation, is oriented in a plane that is parallel to or angled relative to the base, and wherein the posterior brace, the knee-adjacent thigh brace and the foot brace are cooperate in supporting the weight of the user resting on the body support apparatus in a prone position to brace each of the knee-adjacent portion of the user's thigh, the user's posterior, and one or more of the user's feet.

12. The prone body support apparatus of claim 11, further including a media emplacement extending from at least one of the base or the primary frame and disposed below the head support, the media emplacement aligned with the viewing aperture of the head support.

13. The prone body support apparatus of claim 11, wherein the first leg and second leg of the primary frame form a triangular support structure with the base.

14. The prone body support apparatus of claim 11, wherein one or both of the knee-adjacent thigh brace and the foot brace are movable, enabling movement of the user's legs and flexion of the user's knee to about 90 degrees when the user is positioned on the posterior brace and one or both feet of the user are positioned on the foot brace.

15. The prone body support apparatus of claim 14, wherein the foot brace is one of slidable and collapsible.

* * * * *